US011052667B2

(12) United States Patent
Karasawa et al.

(10) Patent No.: US 11,052,667 B2
(45) Date of Patent: Jul. 6, 2021

(54) GAS-ABSORBING APPARATUS, LIQUID HOUSING, LIQUID HOUSING CONTAINER AND LIQUID EJECTING APPARATUS

(71) Applicant: SEIKO EPSON CORPORATION, Tokyo (JP)

(72) Inventors: Masahiro Karasawa, Matsumoto (JP); Kazuyuki Hirata, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/694,140

(22) Filed: Nov. 25, 2019

(65) Prior Publication Data

US 2020/0164655 A1 May 28, 2020

(30) Foreign Application Priority Data

Nov. 27, 2018 (JP) ..... JP2018-220850

(51) Int. Cl.
*B41J 2/175* (2006.01)
*B41J 2/19* (2006.01)

(52) U.S. Cl.
CPC ..... *B41J 2/17523* (2013.01); *B41J 2/19* (2013.01)

(58) Field of Classification Search
CPC ..... B41J 2/17523; B41J 2/19
See application file for complete search history.

(56) References Cited

U.S. PATENT DOCUMENTS

| | | | |
|---|---|---|---|
| 2005/0204921 | A1 | 9/2005 | Ishizawa et al. |
| 2015/0077487 | A1 | 3/2015 | Ishizawa et al. |
| 2017/0100940 | A1 | 4/2017 | Ishizawa et al. |

FOREIGN PATENT DOCUMENTS

| | | | |
|---|---|---|---|
| JP | 4277271 | B2 | 6/2009 |
| JP | 2014-012375 | A | 1/2014 |
| JP | 2015-058543 | A | 3/2015 |
| JP | 2015-174264 | A | 10/2015 |
| JP | 2016-137675 | A | 8/2016 |

OTHER PUBLICATIONS

IP.com search (Year: 2020).*

* cited by examiner

*Primary Examiner* — Lisa Solomon
(74) *Attorney, Agent, or Firm* — Oliff PLC

(57) ABSTRACT

A gas-absorbing apparatus disposed in a liquid housing that has a supply port portion for supplying the liquid to an external, includes a space retaining member that forms an internal space of the gas-absorbing apparatus, and a gas-permeable film that partitions off an inside of the internal space from an outside in a state where the internal space is depressurized to a pressure lower than atmospheric pressure, the gas-absorbing apparatus being separate from the supply port portion.

9 Claims, 9 Drawing Sheets

GAS-ABSORBING APPARATUS, LIQUID HOUSING, LIQUID HOUSING CONTAINER AND LIQUID EJECTING APPARATUS

The present application is based on, and claims priority from JP Application Serial Number 2018-220850, filed Nov. 27, 2018, the disclosure of which is hereby incorporated by reference herein in its entirety.

BACKGROUND

1. Technical Field

The present disclosure relates to a technique for absorbing gas in a liquid.

2. Related Art

There is a known liquid container that has a gas-absorbing apparatus therein (for example, JP-A-2016-137675). The gas-absorbing apparatus is formed integrally with a supply port portion of the liquid container.

When various operating environment conditions such as the amount or type of liquid stored in the liquid container, and the type of liquid container are changed, it is necessary to accordingly change the shape or the like of the gas-absorbing apparatus. In the related art, when the shape or the like of the gas-absorbing apparatus is changed, the design of the supply port portion integrally provided with the gas-absorbing apparatus may also need to be changed. Therefore, the cost required to manufacture the liquid container may increase.

SUMMARY

According to one aspect of the present disclosure, there is provided a gas-absorbing apparatus disposed in a liquid housing that houses a liquid and that has a supply port portion for supplying the liquid to an external part. This gas-absorbing apparatus includes a space retaining member that forms an internal space of the gas-absorbing apparatus, and a gas-permeable film that partitions off an inside of the internal space from an outside in a state where the internal space is depressurized to a pressure lower than atmospheric pressure, the gas-absorbing apparatus being separate from the supply port portion.

DESCRIPTION OF EXEMPLARY EMBODIMENTS

A. First Embodiment

Figure 1:
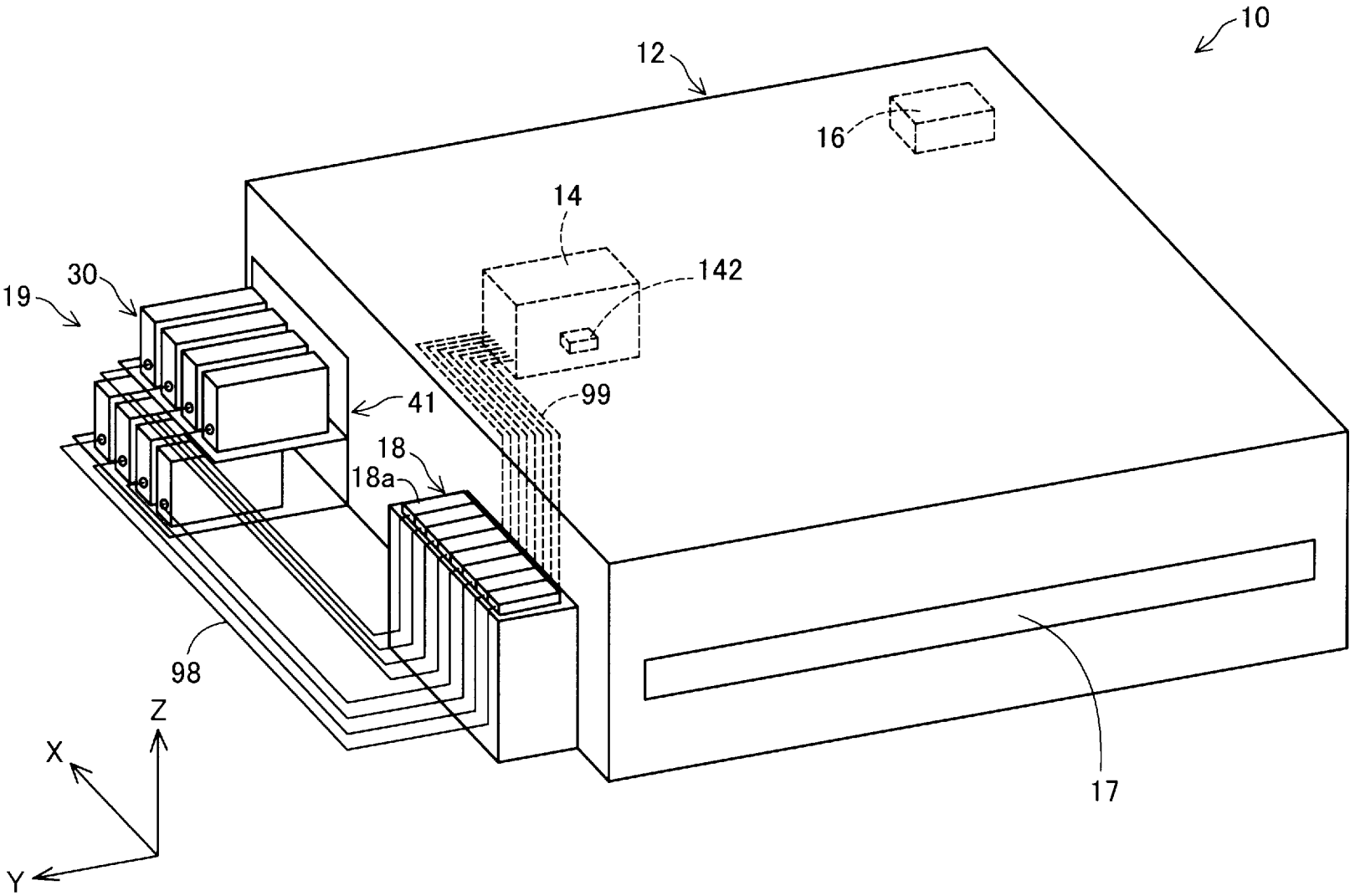
FIG. 1 is a schematic view illustrating a liquid ejecting apparatus according to a first embodiment.

FIG. 1 is a schematic view illustrating a liquid ejecting apparatus 10 according to a first embodiment. The liquid ejecting apparatus 10 includes an outer shell 12, a carriage 14, a control unit 16, a main placement shelf 19, a sub placement shelf 18, and a liquid housing container 30. The liquid ejecting apparatus 10 is an apparatus that ejects a liquid to a medium and that retains the liquid on the medium. The liquid ejecting apparatus 10 is a so-called ink jet printer that performs printing on a medium by ejecting ink as a liquid on the medium. The medium is a print medium such as a sheet, a plate, or a cloth. In the present embodiment, the medium is a cloth. In the present embodiment, the liquid is an ink containing a dye having an azo group. In FIG. 1, three space axes perpendicular to one another, that is, an X axis, a Y axis, and a Z axis are illustrated. The direction along the X axis is taken as the X direction, the direction along the Y axis as the Y direction, and the direction along the Z axis as the Z direction. The liquid ejecting apparatus 10 is installed on an XY plane which is a plane parallel to the X direction and the Y direction. The −Z direction is a vertically downward direction, and the +Z direction is a vertically upward direction. Also in the other drawings described below, the X axis, the Y axis, and the Z axis are attached as necessary.

Eight liquid housing containers 30 are provided. The eight liquid housing containers 30 each contain a liquid of a different color. In the present embodiment, the colors of the liquids stored in the eight liquid housing containers 30 are the eight colors of cyan, magenta, yellow, black, red, blue, orange, and gray. Further, the number of the liquid housing containers 30 is not limited to eight. For example, the number of the liquid housing containers 30 may be seven or less, or nine or more.

The main placement shelf 19 is provided outside the liquid ejecting apparatus 10. The eight liquid housing containers 30 are arranged in the main placement shelf 19.

Eight sub-tanks 18*a* are arranged in the sub placement shelf 18. The eight sub-tanks 18*a* are provided so as to correspond to the eight liquid housing containers 30. The liquid housing containers 30 and the sub-tanks 18*a* corresponding to each other are in communication with each other by flexible first tubes 98.

The carriage 14 has a liquid ejecting head 142 that ejects a liquid. The carriage 14 is disposed in the outer shell 12 and communicates with the sub-tanks 18*a* via flexible second tubes 99 individually provided for each sub-tank 18*a*. The liquid in the sub-tanks 18*a* is supplied to the carriage 14. In the present embodiment, the supply of the liquid from the sub-tanks 18*a* to the liquid ejecting head 142 is performed by a pressure mechanism (not illustrated). The carriage 14 moves in the outer shell 12 along the X-axis direction by a transport mechanism (not illustrated) provided in the liquid ejecting apparatus 10. Thereby, the liquid is ejected to the medium. The medium to which the liquid has been ejected is discharged to the outside of the outer shell 12 from a discharge port 17 provided on a side surface of the outer shell 12.

The control unit 16 is disposed in the outer shell 12. The control unit 16 controls various operations of the liquid ejecting apparatus 10, for example, a printing operation.

Figure 2:
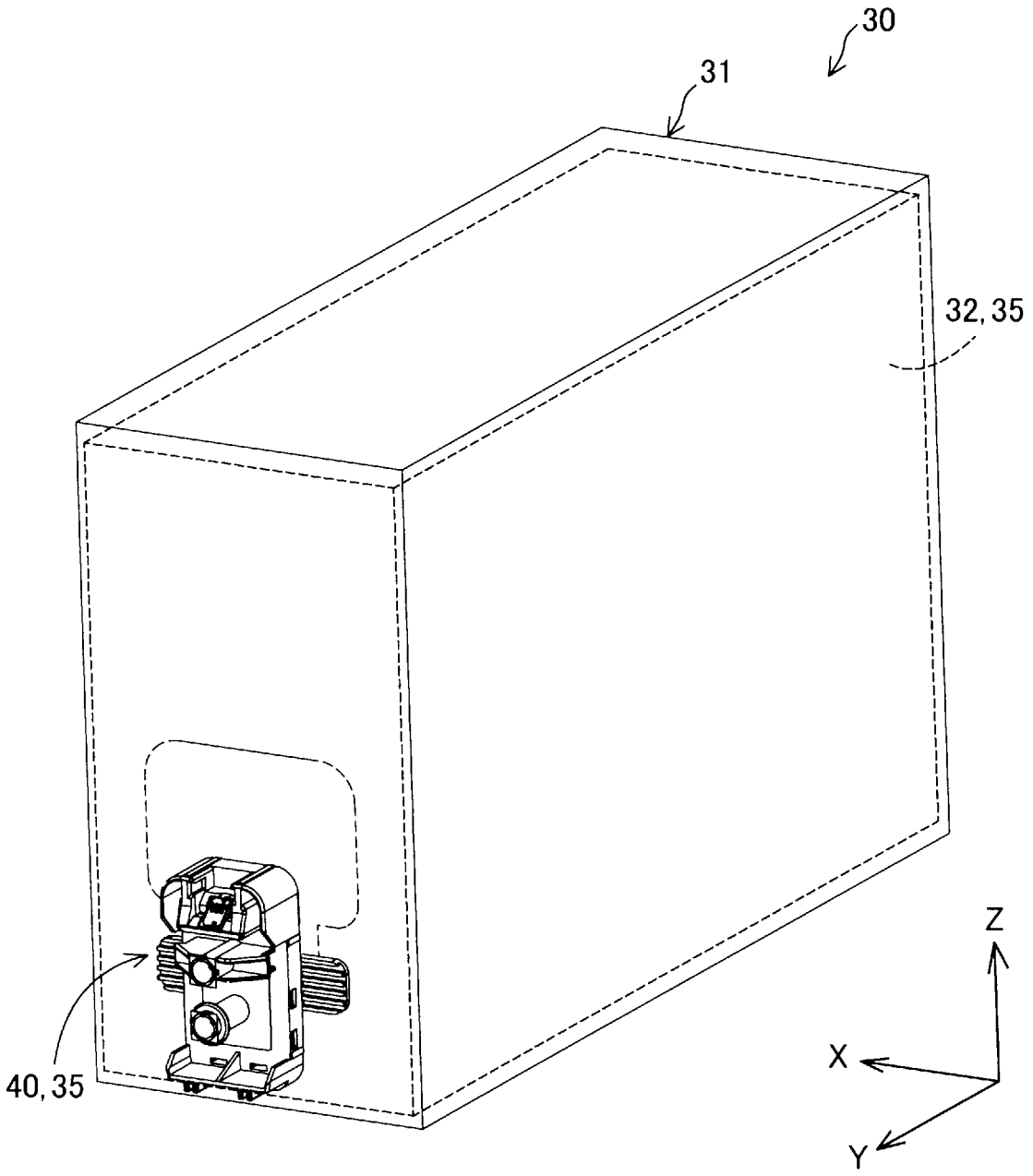
FIG. 2 is a perspective view of a liquid housing container.

FIG. 2 is a perspective view of the liquid housing container 30. The liquid housing container 30 includes a liquid housing 35 and an exterior body 31. The liquid housing 35 is a container capable of housing liquid therein, and in the present embodiment, is a flexible bag-shaped ink pack. The liquid housing 35 has a housing portion 32 of the bag and a supply port portion 40. The supply port portion 40 is formed of a synthetic resin, and forms a flow path coupling the inside and the outside of the housing portion 32. The liquid stored in the housing portion 32 is supplied to the outside through the supply port portion 40. The first tube 98 illustrated in FIG. 1 is coupled to the supply port portion 40.

The exterior body 31 houses the housing portion 32 of the liquid housing 35 therein, and protects the housing portion 32 from an impact or the like applied from the outside. The exterior body 31 has a substantially rectangular parallelepiped outer shape. Any of various materials such as paper and resin can be used for the exterior body 31. In the present embodiment, the exterior body 31 is formed using paper. More specifically, the exterior body 31 is formed of cardboard.

Figure 3:
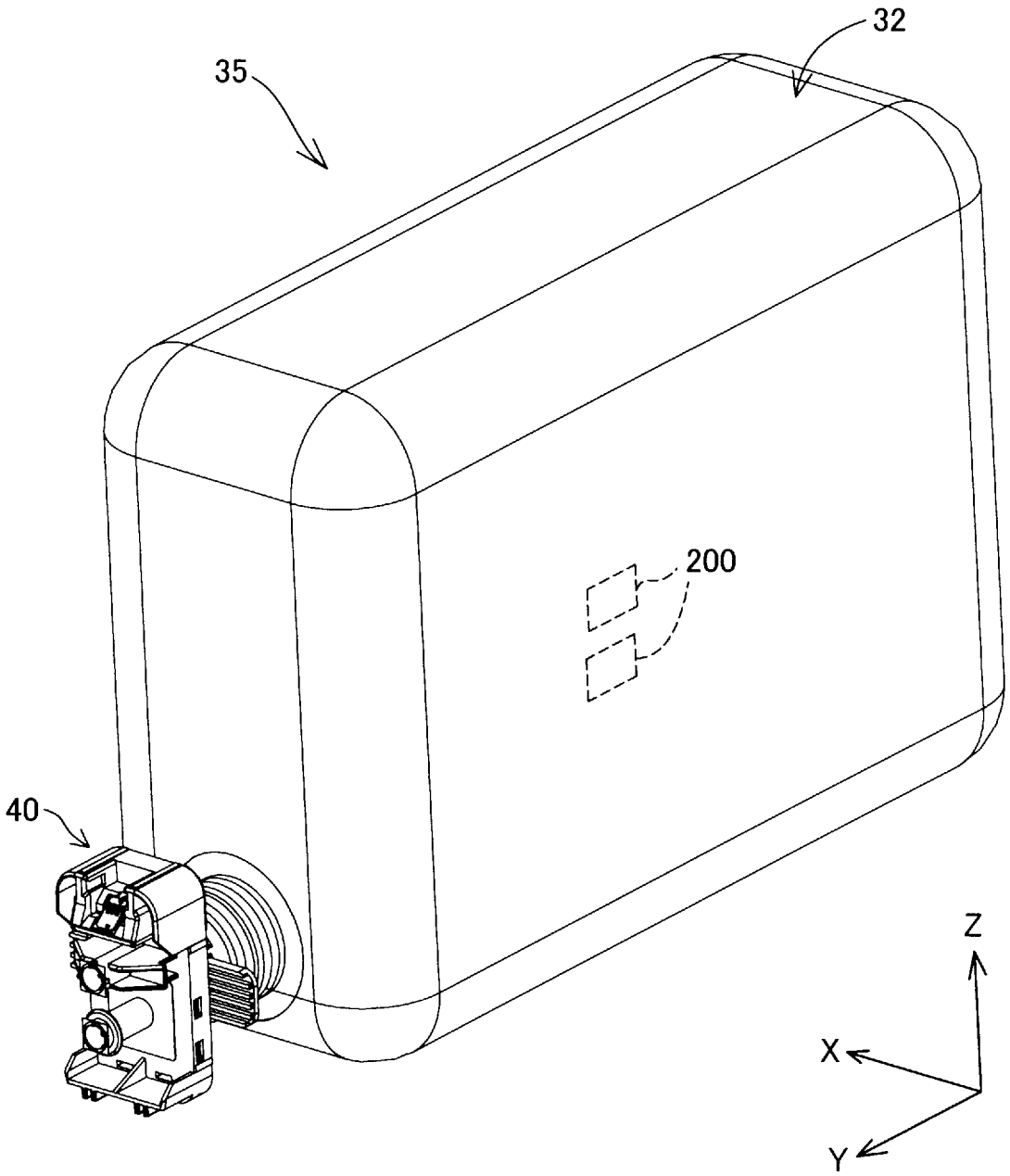
FIG. 3 is a perspective view of a liquid housing.

FIG. 3 is a perspective view of the liquid housing 35. The housing portion 32 forms a housing space for housing a liquid therein. The housing portion 32 decreases in volume as the liquid is consumed. The housing portion 32 is formed of a film member that is flexible, and can suppress the permeation of gas and liquid. Specifically, the film member used to form the housing portion 32 is, for example, an aluminum multi-layer film, a silica vapor-deposited film, or an alumina vapor-deposited film. The film member used to form the housing portion 32 may be a single-layer film or a multi-layer film. In the present embodiment, a two-layer alumina vapor-deposited film is used for the housing portion 32. The capacity of the housing portion 32 is 10 L.

Two gas-absorbing apparatuses 200 are provided in the liquid housing 35. The gas-absorbing apparatuses 200 absorb gas in the liquid. Since the gas in the housing portion 32 is absorbed by the gas-absorbing apparatuses 200, the generation of air bubbles in the liquid housing 35 is suppressed. The amount of gas that can be absorbed by the gas-absorbing apparatuses 200 is determined by the volume of the gas-absorbing apparatuses 200 deployed.

Figure 4:
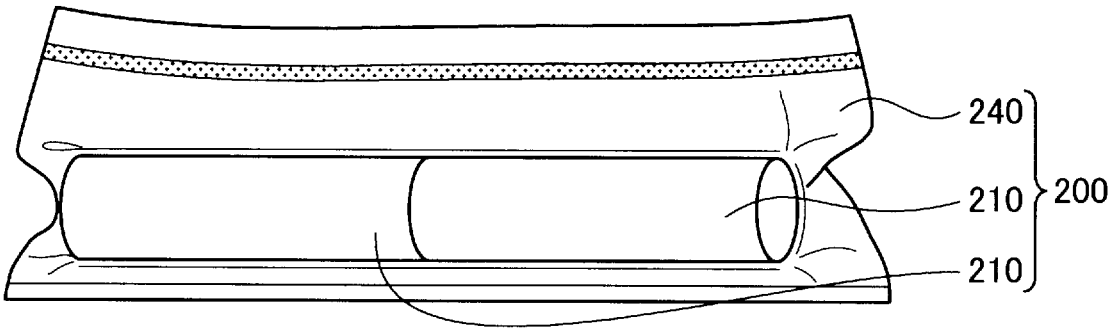
FIG. 4 is a perspective view of a gas-absorbing apparatus.

FIG. 4 is a perspective view of the gas-absorbing apparatus 200. The gas-absorbing apparatus 200 has a space retaining member 210, which is cylindrical, and a gas-permeable film 240 covering the space retaining member 210. In the gas-absorbing apparatus 200, a depressurized space having a pressure lower than atmospheric pressure is formed.

Figure 5:
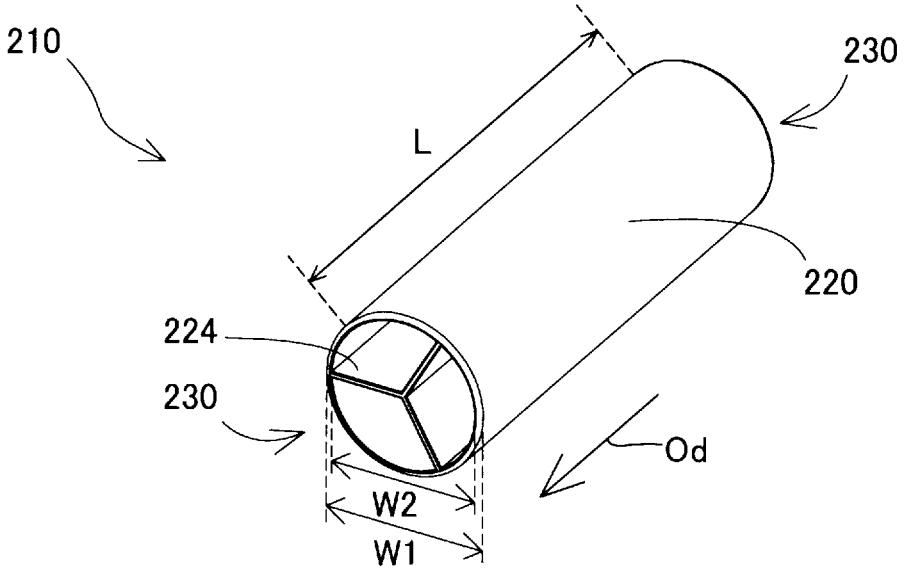
FIG. 5 is a perspective view of a space retaining member.

FIG. 5 is a perspective view of the space retaining member 210. The space retaining member 210 has rigidity and maintains the depressurized space of the gas-absorbing apparatus 200. As illustrated in FIG. 5, the space retaining member 210 has a cylindrical shape. As illustrated in FIG. 4, two space retaining members 210 are housed in the gas-permeable film 240. The two space retaining members 210 have the same shape as each other. In the gas-permeable film 240, the two space retaining members 210 are arranged in a line in the longitudinal direction so as to form one cylindrical shape. In this case, since the size of the space retaining member 210 in the longitudinal direction can be reduced, the formation of the space retaining member 210 is facilitated.

As illustrated in FIG. 5, the space retaining member 210 includes a main body portion 220 forming a depressurized space, which is an internal space of the gas-absorbing apparatus 200, opening portions 230 coupling the inside and the outside of the main body portion 220, and ribs 224 provided on an inner wall surface 222 of the main body portion 220. The length L of the space retaining member 210 in the longitudinal direction is 90 mm, and the length of the two space retaining members 210 housed in the gas-permeable film 240 is 180 mm in total. The outer diameter W1 of the space retaining member 210 is 27.6 mm. The inner diameter W2 of the space retaining member 210 is 25.4 mm. Any of various materials such as resin and metal can be used for the space retaining member 210 as long as a depressurized space can be held. In the present embodiment, the space retaining member 210 is formed of a resin molded by injection molding.

When the space retaining member 210 has a cylindrical shape, it is easy to secure a large volume of the depressurized space in the space retaining member 210 compared with other shapes. In addition, in the case where the shape of the space retaining member 210 is a cylindrical shape, it is easy to adjust the orientation when arranging two space retaining members 210 side by side.

Figure 6:
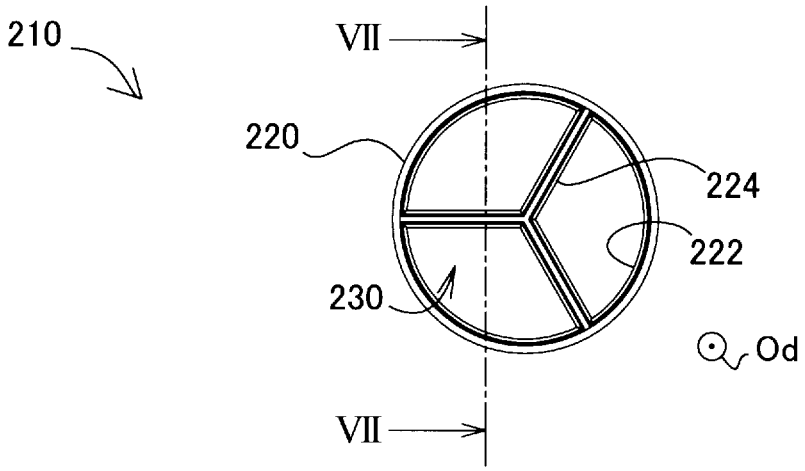
FIG. 6 is a front view of the space retaining member.
Figure 7:
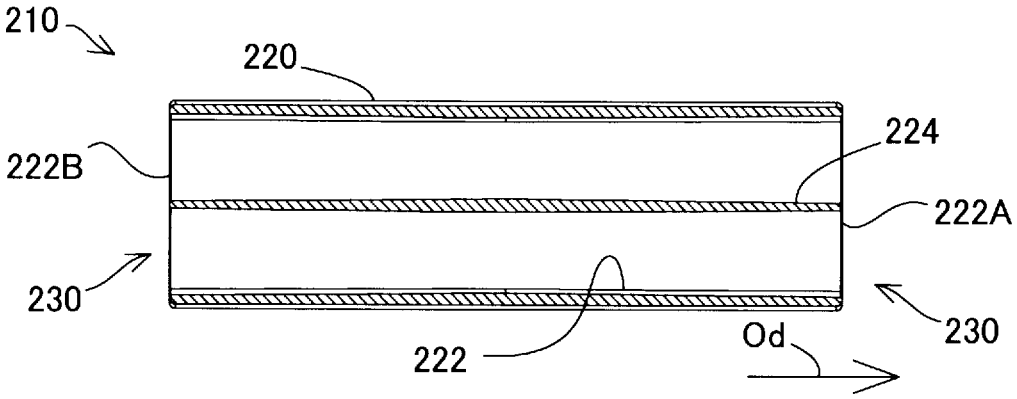
FIG. 7 is a sectional view of the space retaining member in a VII-VII section illustrated in FIG. 6.

FIG. 6 is a front view of the space retaining member 210. FIG. 7 is a sectional view of the space retaining member 210 in a VII-VII section illustrated in FIG. 6. As illustrated in FIG. 6, the ribs 224 extend from the inner wall surface 222 toward the inside of the depressurized space. The ribs 224 are coupled to different portions of the inner wall surface 222 when viewed in an opening direction Od. In the present embodiment, the ribs 224 extend from the inner wall surface 222 every 120 degrees around a center axis of the opening portions 230 and respectively extend from the inner wall surface 222 toward the center of the openings when viewed in the opening direction Od. As illustrated in FIG. 7, the ribs 224 are provided continuously from one end 222A to another end 222B in the opening direction Od of the inner wall surface 222. Since the gas-absorbing apparatus 200 has the ribs 224, it is possible to suppress the deformation of the main body portion 220 caused by a load due to the pressure difference between the depressurized space and the outside. Therefore, it is possible to suppress a decrease in volume in the depressurized space caused by the deformation of the main body portion 220. In addition, the ribs 224 are provided on the one end 222A and the other end 222B of the inner wall surface 222, which define the opening portions 230. For this reason, it is possible to suppress the gas-permeable film 240 from entering the depressurized space from the opening portions 230 due to the pressure difference between the depressurized space and the exterior. As a result, it is possible to suppress a decrease in volume in the depressurized space due to the gas-permeable film 240 entering the depressurized space from the opening portions 230.

As illustrated in FIG. 4, the gas-permeable film 240 is a bag-like member, an opening portion of which is sealed by welding in a state where the space retaining member 210 is housed in the gas-permeable film. The gas-permeable film 240 has gas permeability. The gas-permeable film 240 also suppresses liquid from entering the gas-absorbing apparatus 200. According to the pressure difference, gas moves from the outside to the inside of the gas-absorbing apparatus 200 through the gas-permeable film 240. In this manner, gas can be moved by using the pressure difference between the outside and inside of the gas-absorbing apparatus 200 as a driving force.

For example, a thermoplastic resin can be used for the film member that forms the gas-permeable film 240. In addition, the gas-permeable film 240 is preferably formed of a thermoplastic resin having no reactivity with the liquid in the liquid housing 35, such as polypropylene, polyethylene, or polystyrene. Furthermore, the gas-permeable film 240 is preferably a single-layer film. This is because a single-layer film has a higher gas permeability than a multi-layer film when formed of the same material. In the present embodiment, the gas-permeable film 240 is formed of a single-layer film of polyethylene.

The pressure in the depressurized space needs to be lower than atmospheric pressure. The lower the pressure in the depressurized space, the larger the amount of gas that can be taken in from the outside by the gas-absorbing apparatus 200. On the other hand, the lower the pressure in the depressurized space, the larger the cost and time for manufacturing the gas-absorbing apparatus 200. For this reason, it is preferable to determine the pressure of the depressurized space in consideration of both the capacity of the gas-absorbing apparatus 200 and the cost in manufacturing. For example, the pressure of the depressurized space is preferably in the range of −40 kPa to −95 kPa, and more preferably in the range of −50 kPa to −85 kPa at the time of manufacture of the gas-absorbing apparatus 200. In the present embodiment, the pressure of the depressurized space is −85 kPa at the time of manufacture of the gas-absorbing apparatus 200. Further, a gauge pressure with zero atmospheric pressure is used as the pressure.

The gas-absorbing apparatus 200 is manufactured in a depressurized container adjusted to below a target pressure of the depressurized space of the gas-absorbing apparatus 200. Specifically, in the depressurized container, the gas-absorbing apparatus 200 is manufactured by inserting the space retaining member 210 into the inside of the gas-permeable film 240 through an opening portion of the gas-permeable film 240, and closing the opening portion of the gas-permeable film 240 by welding. In this embodiment, because the space retaining member 210 is housed in the gas-permeable film 240 so that the inside and outside of the depressurized space are partitioned from each other, the time and effort to adjust the positional relationship between the gas-permeable film 240 and the opening portions 230 is reduced. After the opening portion of the gas-permeable film 240 is welded, the gas-absorbing apparatus 200 is removed from the depressurized container. As a result, the pressure in the depressurized space of the gas-absorbing apparatus 200 becomes lower than atmospheric pressure. The gas-absorbing apparatus 200 that has been manufactured is disposed in the liquid housing 35 before filling the liquid housing 35 with liquid. More preferably, it is disposed in the liquid housing 35 just before filling the liquid housing 35 with liquid. The term "just before" means that no other process is inserted between the deployment of the gas-absorbing apparatus 200 and the filling of the liquid housing 35 with liquid.

Even when the liquid housing 35 is filled with liquid subjected to a degassing process for removing gas, gas may be generated in the liquid housing 35. The generation of gas in the housing portion 32 occurs, for example, when the threshold for saturation of dissolved nitrogen, dissolved oxygen, etc. due to a drop in air pressure is lowered. Specifically, for example, when used in a high-altitude area, gas may be generated. Also, for example, gas may be generated in the liquid housing 35 due to the occurrence of a chemical reaction of components in the liquid over time. Specifically, for example, when an ink containing a dye having an azo group as a liquid is used, nitrogen contained in the azo group or the diazo group may become a gas due to a chemical reaction. In addition, the amount of gas generated in the housing portion 32 increases or decreases according to the amount of liquid in the housing portion 32. For this reason, the degassing capability of the liquid housing 35 depends on various conditions such as the amount and type of liquid filled in the liquid housing 35 and the environment in which the liquid housing 35 is to be used, and it is preferable to adjust the degassing capability of the liquid housing 35 at the time of manufacture of the liquid housing 35.

When the gas-absorbing apparatus 200 is used, the degassing capability of the liquid housing 35 can be adjusted by changing the number of the gas-absorbing apparatuses 200 disposed in the liquid housing 35. For example, when the volume of the liquid housing 35 is small, for example, less than 5 L, the number of the gas-absorbing apparatuses 200 may be one. Also, when it is assumed that the use is in areas where the pressure is low, compared with the case where the use is in areas where the pressure is high, the number of the gas-absorbing apparatuses 200 deployed in the same volume of the liquid housing 35 may be increased by one or more. In addition, when a dye having a smaller gas generation amount than a dye having an azo group is used, the number of the gas-absorbing apparatuses 200 may be reduced as long as it is one or more. For example, when using a dye having a smaller gas generation amount than a dye having an azo group, even in the case of the liquid housing 35 having a capacity of 10 L, only one gas-absorbing apparatus 200 need be provided whereas a plurality of the gas-absorbing apparatuses 200 are provided in the case of a dye having an azo group.

Figure 8:
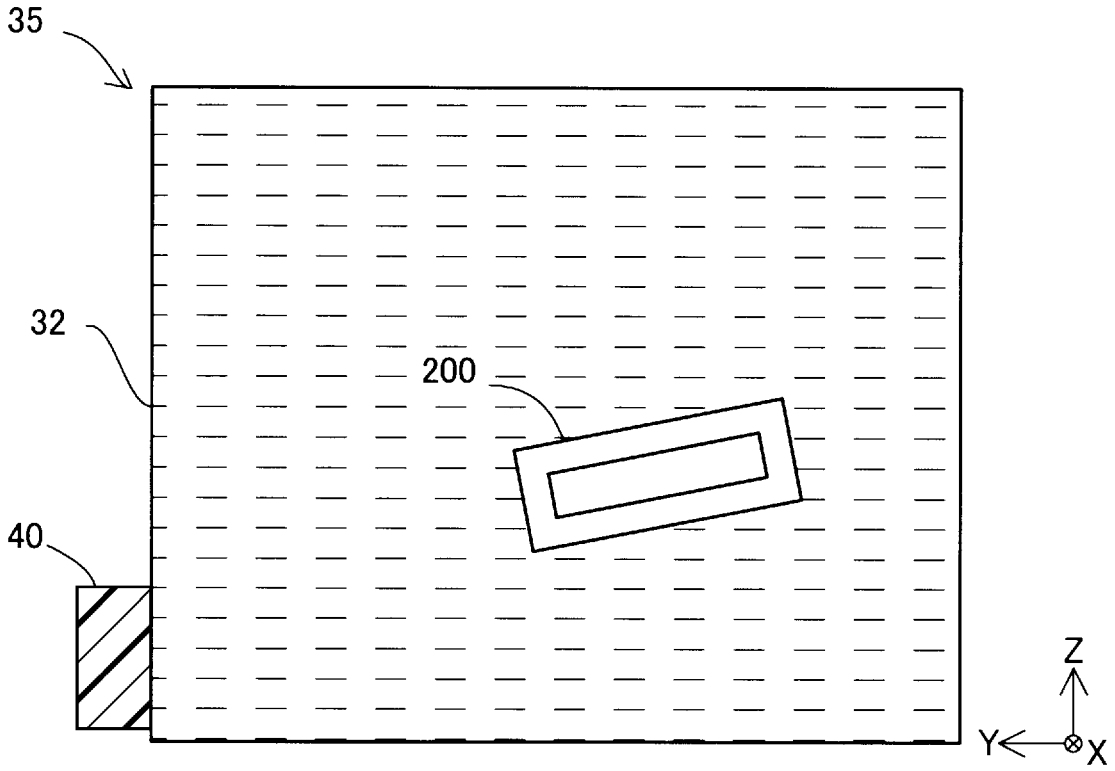
FIG. 8 is a schematic sectional view of the liquid housing.

FIG. 8 is a schematic sectional view of the liquid housing 35. In FIG. 8, the cross section of the liquid housing 35 along the Y-axis direction and the Z-axis direction is schematically illustrated. For convenience of explanation, only one gas-absorbing apparatus 200 is illustrated in FIG. 8. The gas-absorbing apparatus 200 is provided separately from the supply port portion 40. In addition, the gas-absorbing apparatus 200 is also provided separately from the housing portion 32. For this reason, the gas-absorbing apparatus 200 moves freely in the liquid in the liquid housing 35.

Figure 9A:
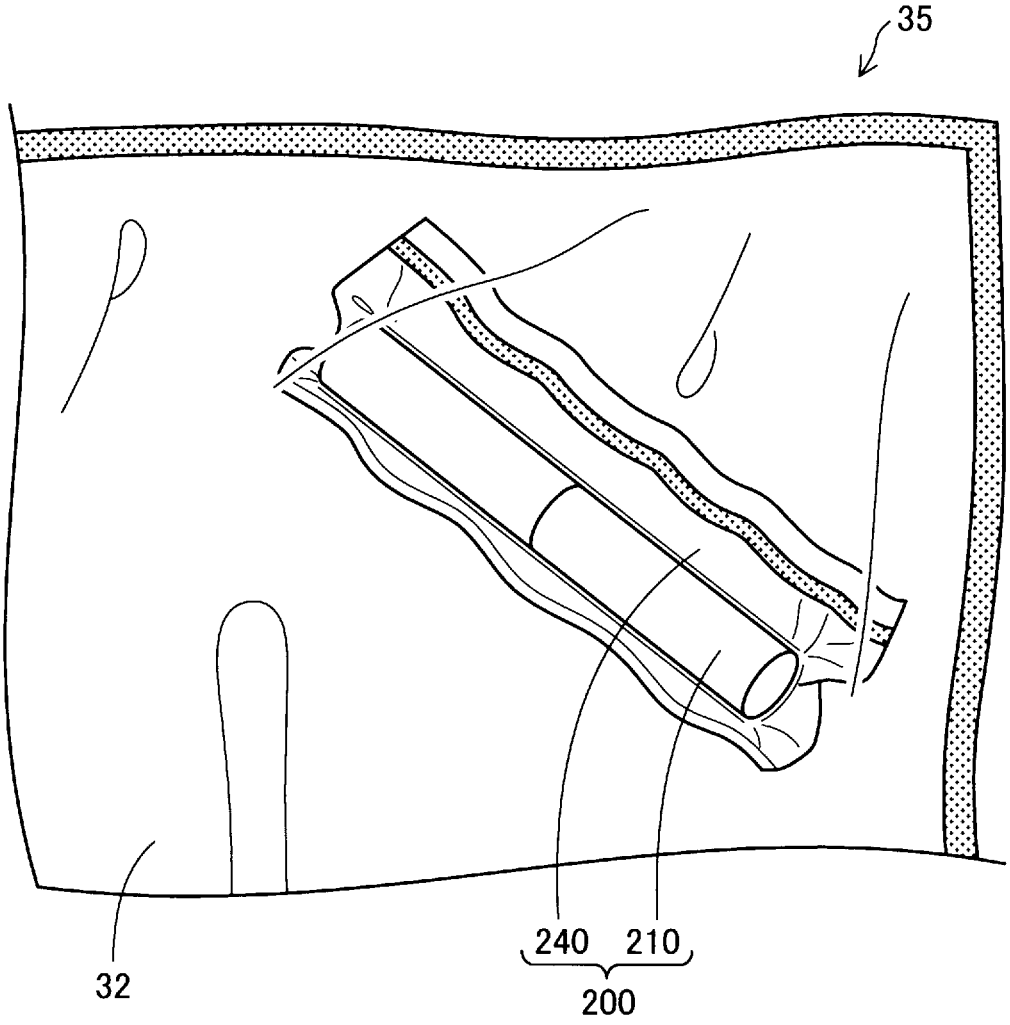
FIG. 9A is a schematic view illustrating a state of the liquid housing of the first embodiment in the case where consumption of liquid has been completed.

FIG. 9A is a schematic view illustrating a state of the liquid housing 35 of the first embodiment in the case where consumption of the liquid has been completed. In the liquid housing 35, the volume of the housing portion 32 is reduced by the consumption of the liquid in the liquid housing 35. As a result, when the consumption of the liquid is completed, the housing portion 32 is in a collapsed state. In this state, the entire area of the outer surface of the gas-absorbing apparatus 200 is in close contact with the film member forming the housing portion 32. This is because the gas-absorbing apparatus 200 is surrounded by the film member that forms the housing portion 32, which has flexibility, due to the gas-absorbing apparatus 200 being a separate body from the supply port portion 40.

Figure 9B:
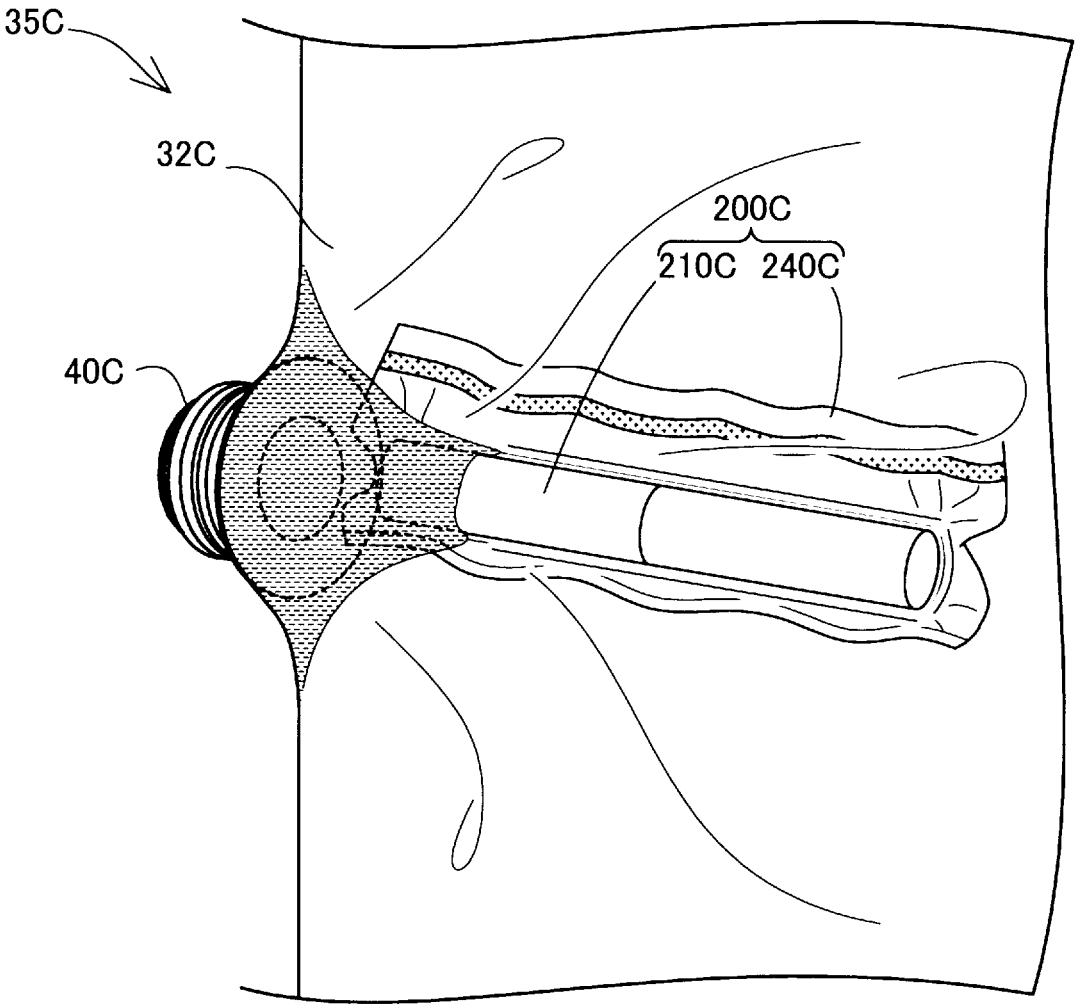
FIG. 9B is a schematic view illustrating a state of a liquid housing of a comparative example in the case where consumption of liquid has been completed.

FIG. 9B is a schematic view illustrating a state of a liquid housing 35C when the consumption of the liquid is completed in the comparative example. In the comparative example, "C" is attached to the end of the reference signs in the first embodiment for configurations corresponding to respective configurations of the liquid housing 35 according to the first embodiment, and detailed description thereof is omitted. The liquid housing 35C according to the comparative example differs from the liquid housing 35 according to the first embodiment in that a gas-absorbing apparatus 200C is fixed to a supply port portion 40C. As illustrated in FIG. 9B, even when the consumption of the liquid is completed, a portion of a housing portion 32C may not be in a crushed state. In this state, a portion of the outer surface of the gas-absorbing apparatus 200C is not in close contact with the film member forming the housing portion 32C. This is because a space is retained in the housing portion 32C by the supply port portion 40C and the gas-absorbing apparatus 200C, which have higher rigidity than the housing portion 32C, due to the gas-absorbing apparatus 200C being fixed to the supply port portion 40C. Thus, in the comparative example, unconsumable liquid may be generated in the liquid housing 35C.

In the first embodiment, compared with the comparative example, the liquid can be suppressed from remaining in a region where the outer surface of the gas-absorbing apparatus 200 and the film member forming the housing portion 32 are not in close contact with each other. This can suppress the generation of unconsumable liquid in the liquid housing 35.

According to the first embodiment described above, the gas-absorbing apparatus 200 is separate from the supply port portion 40 of the liquid housing 35. For this reason, in the case of changing the degassing ability of the liquid housing 35 according to the change of the use environment condition, the necessity for a design change of the liquid housing 35 is reduced. Furthermore, in the present embodiment, the degassing capability of the liquid housing 35 is adjusted in accordance with the number of the gas-absorbing apparatuses 200, so the need for design change of the gas-absorbing apparatus 200 is also reduced. Therefore, the likelihood of increasing the cost required for manufacturing the liquid housing 35 and the gas-absorbing apparatus 200 can be reduced.

B. Second Embodiment

Figure 10:
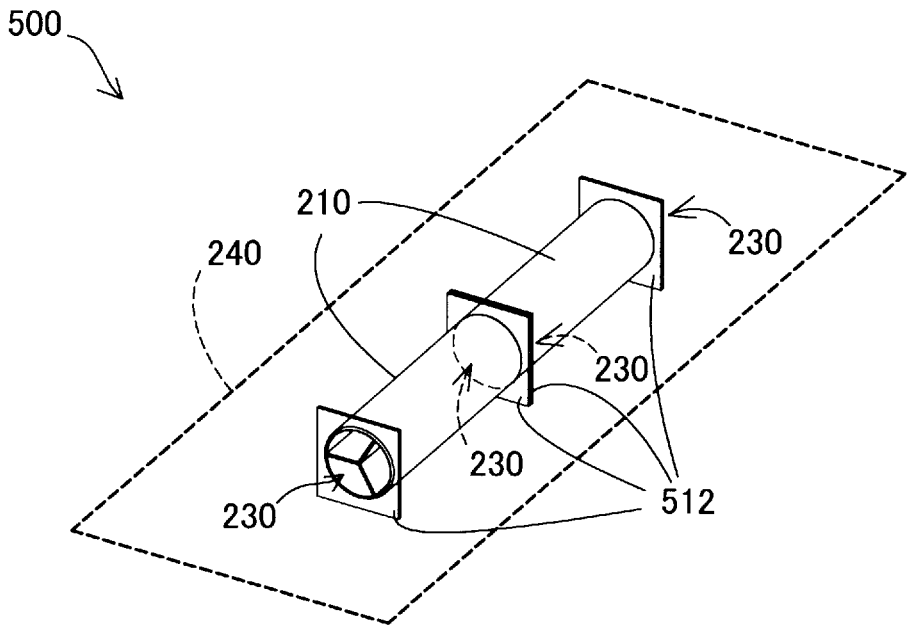
FIG. 10 is a schematic view of a gas-absorbing apparatus according to a second embodiment.

FIG. 10 is a schematic view illustrating a gas-absorbing apparatus 500 of a second embodiment. Below, the same reference signs are given to the same components as those of the first embodiment and detailed description thereof is omitted. The gas-absorbing apparatus 500 differs from the gas-absorbing apparatus 200 according to the first embodiment in that sealing films 512 that cover the opening portions 230 of the space retaining member 210 are provided in addition to the space retaining member 210 and the gas-permeable film 240.

The sealing films 512 are film members having gas permeability, and are welded to the opening portions 230. In the present embodiment, film members formed of the same material as the gas-permeable film 240 are used as the sealing films 512.

Similar to the gas-absorbing apparatus 200 according to the first embodiment, the gas-absorbing apparatus 500 is manufactured in a depressurized container adjusted to below a target pressure of the depressurized space. Specifically, first, the sealing films 512 are welded to the opening portions 230 of the space retaining member 210 in the depressurized container. Next, after the space retaining member 210 to which the sealing films 512 have been welded is inserted into the inside of the gas-permeable film 240 from the opening portion of the gas-permeable film 240, the opening portion of the gas-permeable film 240 is closed by welding. Consequently, the gas-absorbing apparatus 500 is manufactured.

According to the second embodiment described above, the same effects can be obtained in that the configuration is the same as that of the first embodiment. Furthermore, according to the second embodiment, the depressurized space, which is the internal space of the space retaining member 210, is partitioned off from the outside by the sealing films 512 in addition to the gas-permeable film 240. Thereby, two film members are provided between the depressurized space and the outside. For this reason, the absorption speed of the gas by the gas-absorbing apparatus 500 can be reduced. Therefore, the gas-absorbing apparatus 500 of the second embodiment can absorb gas over a longer period of time, as compared with the case where the absorption rate is large.

C. Third Embodiment

Figure 11:
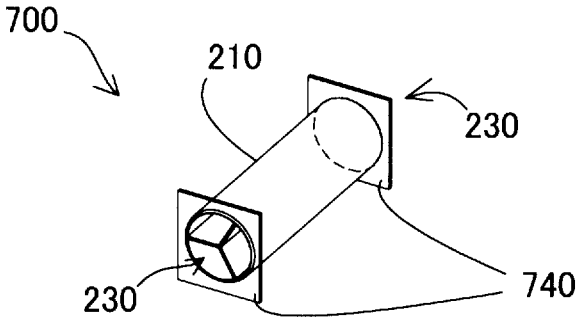
FIG. 11 is a schematic view of a gas-absorbing apparatus according to a third embodiment.

FIG. 11 is a schematic view illustrating a gas-absorbing apparatus 700 of a third embodiment. Below, the same reference signs are given to the same components as those of the first embodiment and detailed description thereof is omitted. In the gas-absorbing apparatus 700, the opening portions 230 of the space retaining member 210 are sealed by gas-permeable films 740, thereby dividing the inside and outside of the depressurized space. That is, the space retaining member 210 only has the gas-permeable films 740 welded to the opening portions 230, and is not housed in the gas-permeable film 240.

According to the third embodiment described above, compared with the case where the space retaining member 210 is housed in the gas-permeable film 240, the transmission area of the gas-permeable film 240 is reduced. Therefore, in the gas-absorbing apparatus 700, the absorption rate at which gas is taken into the depressurized space is reduced. Therefore, the gas-absorbing apparatus 700 of the third embodiment can absorb gas over a longer period of time, as compared with the case where the absorption rate is large. In addition, in the gas-absorbing apparatus 700 of the third embodiment, the size of the gas-permeable film 240 can be reduced as compared with the case where the space retaining member 210 is housed in the gas-permeable film 240.

D. Other Embodiments

D1. First Other Embodiment

In the above embodiments, the gas-absorbing apparatuses 200 and 500 are housed in the liquid housing 35 so as to be freely movable in the liquid housing 35. However, the movement of the gas-absorbing apparatuses 200 and 500 may be restricted as long as the gas-absorbing apparatuses 200 and 500 are separate from the supply port portion 40. For example, the gas-absorbing apparatuses 200 and 500 may be adhered to the surface of the housing portion 32. Also, for example, the movement of the gas-absorbing apparatuses 200 and 500 may be restricted by coupling the gas-absorbing apparatuses 200 and 500 to the housing portion 32 with a cord-like member.

D2. Second Other Embodiment

In the above embodiment, the adjustment of the degassing capability in the liquid housing 35 is performed by adjusting the number of the gas-absorbing apparatuses 200. However, the method of adjusting the degassing capability in the liquid housing 35 is not limited to this. For example, the degassing capability in the liquid housing 35 may be adjusted by changing the size of the gas container.

D3. Third Other Embodiment

In the above embodiment, the shape of the space retaining member 210 is a cylindrical shape having two opening portions 230. However, the shape of the space retaining member 210 can be changed as long as the depressurized space of the gas-absorbing apparatuses 200 and 500 can be formed. For example, the space retaining member 210 need not have one of the two opening portions 230. Also, for example, the space retaining member 210 may have one opening portion 230 formed in the wall surface of the main body portion 220 instead of or in addition to the two opening portions 230. In addition, the space retaining member 210 may be a tubular member having a shape other than the cylindrical shape, for example, a polygonal tubular shape. Also, for example, the space retaining member 210 may be in the shape of a hollow sphere having an opening portion in a portion of the wall surface. In the gas-absorbing apparatus 200 of the first embodiment, the space retaining member 210 may be formed of a porous member such as resin or metal or a net-like member.

D4. Fourth Other Embodiment

In the above embodiment, the ribs 224 are provided continuously from the one end 222A to the other end 222B in the opening direction Od of the inner wall surface 222. However, the ribs 224 need not be provided continuously from the one end 222A to the other end 222B. For example, the ribs 224 may be provided on at least a portion of the opening direction Od on the inner wall surface 222 of the main body portion 220. Even in this case, the ribs 224 can suppress the deformation of the main body portion 220 caused by a load due to the pressure difference between the depressurized space and the outside. In addition, preferably, the ribs 224 are provided at the one end 222A and the other end 222B of the inner wall surface 222 defining the opening portions 230. In addition, the shape of the ribs 224 can be appropriately changed as long as the deformation of the main body portion 220 can be suppressed. The ribs 224 are integrally molded with the main body portion 220 in the above embodiment, but may be separate members. In addition, the ribs 224 may be omitted.

Even in the first to fourth other embodiments described above, similar effects can be achieved in that they have the same configuration as the first and second embodiments.

D5. Fifth Other Embodiment

The present disclosure is not limited to the ink jet printer and the ink tank for supplying the ink to the ink jet printer, but is also applicable to any liquid ejecting apparatus that ejects various liquids including ink and a liquid tank for containing the liquid. For example, the present disclosure can be applied to various liquid ejecting apparatuses and liquid housing containers thereof as described below.

(1) An image recording apparatus such as a facsimile machine.

(2) A color material ejecting apparatus used for manufacturing a color filter for an image display device such as a liquid crystal display.

(3) An electrode material ejecting apparatus used for forming electrodes of an organic electroluminescence (EL) display, a surface emitting display (field emission display (FED)), and the like.

(4) A liquid ejecting apparatus for ejecting a liquid containing bioorganic matter used for biochip manufacture.

(5) A sample ejecting apparatus as a precision pipette.

(6) A lubricating oil ejecting apparatus.

(7) A resin liquid ejecting apparatus.

(8) A liquid ejecting apparatus that ejects lubricating oil pinpoint to a precision machine such as a watch or a camera.

(9) A liquid ejecting apparatus for ejecting a transparent resin liquid such as an ultraviolet curable resin liquid on a substrate to form a micro hemispherical lens (optical lens) or the like used for an optical communication element or the like.

(10) A liquid ejecting apparatus for ejecting an acidic or alkaline etching solution for etching a substrate or the like.

(11) A liquid ejecting apparatus comprising a liquid ejecting head for ejecting any other minute amount of liquid droplets.

Further, "droplet" refers to a state of liquid ejected from a liquid ejecting apparatus, including grains, teardrops, and thread-like tails. In addition, as used herein, the term "liquid" may be any material that can be ejected by a liquid ejecting apparatus. For example, the term "liquid" may refer to any material as long as the material is in a liquid phase, for example, liquid materials such as materials having a high or low viscosity state, sols, gel water, other inorganic solvents, organic solvents, liquid resin and liquid metal (metal melt) are also covered by the term "liquid". In addition, not only liquid as one state of matter, but also particles of a functional material composed of a solid material such as pigment and metal particles dissolved, dispersed or mixed in a solvent are covered by the term "liquid". Representative examples of liquids include ink and liquid crystal. Herein, examples of ink include various liquid compositions such as a general aqueous ink and an oil-based ink and gel ink.

The present disclosure is not limited to the above-described embodiment, and can be realized in various configurations without departing from the gist thereof. For example, the technical features of the embodiments corresponding to the technical features in each of the aspects described in the summary of the disclosure may be used to solve some or all of the above-mentioned problems, and may be replaced or combined as necessary in order to accomplish some or all of the effects of the disclosure. In addition, unless technical features are not described as essential in the present specification, they can be deleted as appropriate.

(1) According to one aspect of the present disclosure, there is provided a gas-absorbing apparatus disposed in a liquid housing that houses a liquid and that has a supply port portion for supplying the liquid to an external part. The gas-absorbing apparatus includes a space retaining member that forms an internal space of the gas-absorbing apparatus, and a gas-permeable film that partitions off an inside of the internal space from an outside in a state where the internal space is depressurized to a pressure lower than atmospheric pressure, the gas-absorbing apparatus being separate from the supply port portion. According to this aspect, the gas-absorbing apparatus is separate from the supply port portion. For this reason, in the case of changing the design of the gas-absorbing apparatus according to the change of the use environment condition, the necessity for a design change of the liquid housing is reduced.

(2) In the gas-absorbing apparatus of the above aspect, the space retaining member may have a main body forming the internal space, and an opening portion coupling an inside and an outside of the main body, and by housing the space retaining member, the gas-permeable film may partition off the inside of the internal space from the outside. According to the gas-absorbing apparatus of this aspect, the space retaining member is housed in the gas-permeable film so that the inside and outside of the internal space are partitioned from each other. For this reason, at the time of manufacture of the gas-absorbing apparatus, the time and effort to adjust the positional relationship of a gas permeation film and an opening portion is reduced.

(3) The gas-absorbing apparatus of the above aspect may further include a sealing film that has gas permeability and that seals the opening portion. According to the gas-absorbing apparatus of this aspect, two film members are provided between the internal space and the outside. Therefore, the rate of absorption of gas by the gas-absorbing apparatus can be adjusted to be low.

(4) In the gas-absorbing member of the above aspect, the space retaining member may have a main body forming the internal space, and an opening portion coupling an inside and an outside of the main body, and, by sealing the opening portion in a state where the internal space is depressurized, the gas-permeable film may partition off the inside of the internal space from the outside. According to the gas-absorbing apparatus of this aspect, the gas-permeable film becomes smaller.

(5) In the gas-absorbing apparatus of the above aspect, the space retaining member may have a cylindrical shape. According to the gas-absorbing apparatus of this aspect, it is easy to secure a large volume of the internal space as compared with other shapes.

(6) In the gas-absorbing apparatus of the above aspect, the space retaining member may include a rib provided at an inner wall surface of the main body portion. According to this aspect, since the gas-absorbing apparatus has the rib, it is possible to suppress the deformation of the main body portion caused by a load due to the pressure difference between the internal space and the outside.

(7) In the gas-absorbing apparatus of the above aspect, the rib may be, within the inner wall surface, provided at least in a portion defining the opening portion. According to the gas-absorbing apparatus of this aspect, the pressure difference between the internal space and the outside suppresses intrusion of the gas-permeable film from the opening portion to the internal space.

(8) According to another aspect of the present disclosure, there is provided a liquid housing that houses a liquid. The liquid housing includes a supply port portion for supplying the liquid to an external part, and the gas-absorbing apparatus of the above aspect, the gas-absorbing apparatus being disposed in the liquid housing. According to the liquid housing of this aspect, the gas-absorbing apparatus is separate from the supply port portion. For this reason, in the case of changing the design of the gas-absorbing apparatus in accordance with the change of the use environment condition, the necessity for a design change of the liquid housing is reduced.

(9) According to another aspect of the present disclosure, a liquid housing container mounted on a liquid ejecting apparatus is provided. The liquid housing container includes the liquid housing of the above-described embodiment, and an exterior body for housing the liquid housing body. According to this aspect, the gas-absorbing apparatus is separate from the supply port portion. For this reason, in the case of changing the design of the gas-absorbing apparatus according to the change of the use environment condition, the necessity for a design change of the liquid housing is reduced.

(10) According to another aspect of the present disclosure, there is provided a liquid ejecting apparatus that ejects a liquid on a medium. The liquid ejecting apparatus of this aspect includes the liquid housing container of the above aspect, and a liquid ejecting head that ejects a liquid housed in the liquid housing container to the medium. According to the liquid ejecting head of this aspect, the gas-absorbing apparatus is separate from the supply port portion. For this reason, in the case of changing the design of the gas-absorbing apparatus according to the change of the use environment condition, the necessity for a design change of the liquid housing is reduced.

The present disclosure can also be realized in various forms other than the gas-absorbing apparatus, the liquid housing, the liquid housing container, and the liquid ejecting apparatus. For example, the present disclosure can be realized in the form of a gas-absorbing apparatus, a liquid housing, a liquid housing container or a method of manufacturing a liquid ejecting apparatus.

What is claimed is:

1. A gas-absorbing apparatus disposed in a liquid housing that has a supply port portion for supplying a liquid to an external, the gas-absorbing apparatus comprising:

a space retaining member that forms an internal space in the gas-absorbing apparatus; and a gas-permeable film that partitions off an inside of the internal space from an outside in a state where the internal space is depressurized to a pressure lower than atmospheric pressure, wherein:

the gas-absorbing apparatus is separate from the supply port portion, the space retaining member has a main body forming the internal space, and an opening portion coupling an inside and an outside of the main body, and the gas-permeable film partitions off the inside of the internal space from the outside by housing the space retaining member.

2. The gas-absorbing apparatus according to claim 1, further comprising:

a sealing film that has gas permeability and that seals the opening portion.

3. A gas-absorbing apparatus disposed in a liquid housing that has a supply port portion for supplying a liquid to an external, the gas-absorbing apparatus comprising:

a space retaining member that forms an internal space in the gas-absorbing apparatus; and a gas-permeable film that partitions off an inside of the internal space from an outside in a state where the internal space is depressurized to a pressure lower than atmospheric pressure, wherein:

the gas-absorbing apparatus is separate from the supply port portion, the space retaining member has a main body forming the internal space, and an opening portion coupling an inside and an outside of the main body, and the gas-permeable film partitions off the inside of the internal space from the outside by sealing the opening portion in a state where the internal space is depressurized.

4. The gas-absorbing apparatus according to claim 1, wherein the space retaining member has a cylindrical shape.

5. The gas-absorbing apparatus according to claim 1, wherein the space retaining member includes a rib provided at an inner wall surface of the main body.

6. The gas-absorbing apparatus according to claim 5, wherein the rib is, within the inner wall surface, provided at least in a portion defining the opening portion.

7. A liquid housing that houses a liquid, the liquid housing comprising:

a supply port portion for supplying the liquid to an external part; and the gas-absorbing apparatus according to claim 1, the gas-absorbing apparatus being disposed inside the liquid housing.

8. A liquid housing container that is mounted on a liquid ejecting apparatus, the liquid housing container comprising:

the liquid housing according to claim 7; and an exterior body for housing the liquid housing.

9. A liquid ejecting apparatus that ejects a liquid on a medium, the liquid ejecting apparatus comprising:

the liquid housing container according to claim 8; and a liquid ejecting head that ejects a liquid housed in the liquid housing container to the medium.

* * * * *